US005163239A

United States Patent [19]

Lampe

[11] Patent Number: 5,163,239

[45] Date of Patent: Nov. 17, 1992

[54] SNOW THROWER DISCHARGE CHUTE BLOCKAGE REMOVING APPARATUS

[76] Inventor: Dennis P. Lampe, 79410 M-40 Hwy., Lawton, Mich. 49065

[21] Appl. No.: 804,889

[22] Filed: Dec. 6, 1991

[51] Int. Cl.[5] ..... E01H 5/09

[52] U.S. Cl. ..... 37/260; 239/123

[58] Field of Search ..... 37/260-262; 239/114, 123

[56] References Cited

U.S. PATENT DOCUMENTS

| | | | |
|---|---|---|---|
| 2,709,311 | 5/1955 | Cady | 37/260 |
| 3,264,763 | 8/1966 | Arps et al. . | |
| 3,497,263 | 2/1970 | Heth et al. | 37/260 |
| 3,921,315 | 11/1975 | Tome | 37/260 |
| 4,068,397 | 1/1978 | Bacon | 37/260 |
| 4,761,901 | 8/1988 | Szafarz | 37/262 |
| 4,898,784 | 2/1991 | Fairchild | 239/114 |
| 4,951,703 | 8/1990 | Olmr | 37/262 |

*Primary Examiner*—Randolph A. Reese
*Assistant Examiner*—Spencer Warnick
*Attorney, Agent, or Firm*—Welsh & Katz, Ltd.

[57] ABSTRACT

An apparatus for safely dislodging accumulated snow and ice from the discharge chute of a rotary snow thrower, which includes a rigid plate adapted to be inserted in and removed from the discharge chute. The rigid plate is movably connected to an element of the snow thrower and is operatively connected to a handle. Rotation of the handle by the operator will selectively move the rigid plate within the discharge chute. The rigid plate will apply an axial force to the accumulated snow and ice, thereby dislodging the snow and ice without the plate coming into contact with the impeller.

10 Claims, 2 Drawing Sheets

SNOW THROWER DISCHARGE CHUTE BLOCKAGE REMOVING APPARATUS

FIELD OF THE INVENTION

The present invention relates to devices for safely clearing packed snow from the discharge chute of snow throwers, and more particularly to apparatus for cleaning such packed snow without endangering the hands of the operator of the snow thrower.

BACKGROUND OF THE INVENTION

A common problem with conventional type snow throwers is that the chute through which the snow is discharged can become obstructed with compacted plugs of snow and ice. This compaction typically occurs throughout the snow discharge chute. It thus becomes necessary for the operator to clean out the movable portion of the chute, and to displace the snow and ice in the lower stationary portion of of the chute into the impeller area so that it will e discharged upon subsequent operation of the thrower. Operators, sometimes employ their hands or a stick to clean out the directional movable portion and to dislodge the snow in the lower stationary portion of the chute. If the impeller blades are turning and the stick or hand comes into contact with them, injury to the operator can result. Recognizing this tendency of operator behavior, and knowing that an operator will not want to stop and restart the motor to accomplish this cleaning, snow thrower manufacturers have equipped their machines with clutches so that the impeller blades may be temporarily disengaged from the rotational energy supplied by the motor. The impeller blades will, however, continue to turn idly due to their rotational inertia. This creates a very dangerous situation as the operator may begin to clean out the discharge chute under a mistaken belief that because the clutch has been disengaged there is not rotation of the impeller blades.

Prior devices, as disclosed in U.S. Pat. Nos. 3,497,263 and 4,761,901, have attempted to prevent injuries to the operator by placing guards to prevent the insertion of the operator's hand into the discharge chute. These obstructions however also impede the flow of ice and snow through the discharge chute thus contributing to the accumulation problem. These guards also prevent the operator form clearing the discharge chute. for these reasons, operators will frequently remove these devices, thus negating their safety function.

In an attempt to safely dislodge accumulated ice and snow from the discharge chute, one device, as disclosed in U.S. Pat. No. 3,921,315, employs a spring loaded "M" shaped element pivotally mounted in the chute, and several prongs which extend from the movable portion into the stationary portion. The "M" shaped element prevents insertion of the operator's hand and upon rotation of the movable potion, the prongs presumably scrape any accumulated ice and snow from the inner surfaces of the stationary portion. This device si ineffective in a number of snow throwers. The "M" shaped element suffers from the same drawbacks described above as of the guards, and the prongs are not adapted to dislodge any accumulations blocking the movable portion. In addition any hindrance to the free rotation of the movable portion renders ineffective the prongs as a method for dislodging snow and ice. Such a hindrance may come about from corrosion occurring and/or ice collecting in the relief between the movable portion and stationary portion. Finally, the structure of the plug may be such that the portion of the lug in the movable portion may support the portion of the plug in the stationary portion and the scraping of the prongs around the circumference of the stationary portion may not cause the plug in the stationary portion to dislodge.

SUMMARY OF THE INVENTION

It is therefore an object of the present invention to provide an improved device for the clearing of accumulated ice and snow from the stationary portion of the discharge chute of a snow thrower without endangering the hands and arms of the operator.

It is a further object of this invention to provide a snow thrower device which an operator may employ to clear out accumulations of ice and snow from the movable portion of the discharge chute.

It is a further object of this invention to provide this safety to the operator without contributing to the accumulation problem by partially blocking the discharge chute through the use of a guard.

The present invention features an apparatus which provides an improved, safe method for the dislodging of accumulated, packed snow located in the discharge cute of a snow thrower. This apparatus applies an axial force to the snow and ice in the stationary portion of the discharge chute while preventing the operator form coming into contact with the rotating blades of the impeller.

This invention includes rigid plate means which are movably connected to an element of the snow thrower. The rigid plate means is adapted to be inserted into and removed from the stationary portion of the discharge chute. Actuating means are operatively connected to the rigid plate means to selectively move the rigid plate means into and out of the discharge chute.

IN a preferred embodiment, the removal device consists of a handle which is attached to a laterally extending rod. The rod ends are adapted to be removably inserted into slotted brackets which are attached on each side of the entrance to the discharge chute. The connection between the rod and slotted brackets allows for pivotal movement of the handle, thereby selectively moving the rigid plate means into and out of the stationary portion of the discharge chute. The selective movement of the rigid plate means applies an axial force to the snow and ice in the stationary portion of the discharge chute, thus dislodging the snow and ice into the impeller housing The configuration of the handle, pivotal connection and plate means prevent the plate from coming into contact with the impeller blades.

The rigid plate means, with attached handle and laterally extending rod, is stored between uses on storage brackets affixed of the snow thrower's housing. The plate means can also e used as a shovel to scoop out any accumulations of snow and ice in the movable portion of the discharge cute. After using the removal device to dislodge snow and ice in the stationary portion of the discharge chute, the operator can then remove the apparatus form its mounting brackets, easily store the removal device on its storage brackets, and upon reengaging the clutch, jettison snow, which was dislodge into the impeller area, through the now cleared discharge chute.

Both existing snow throwers and snow thrower designs can be easily adapted to employ this remoavable device, yet the removal device greatly increases the safety of a snow throswer's use.

DESCRIPTION OF THE PREFERRED EMBODIMENT

Figure 1:
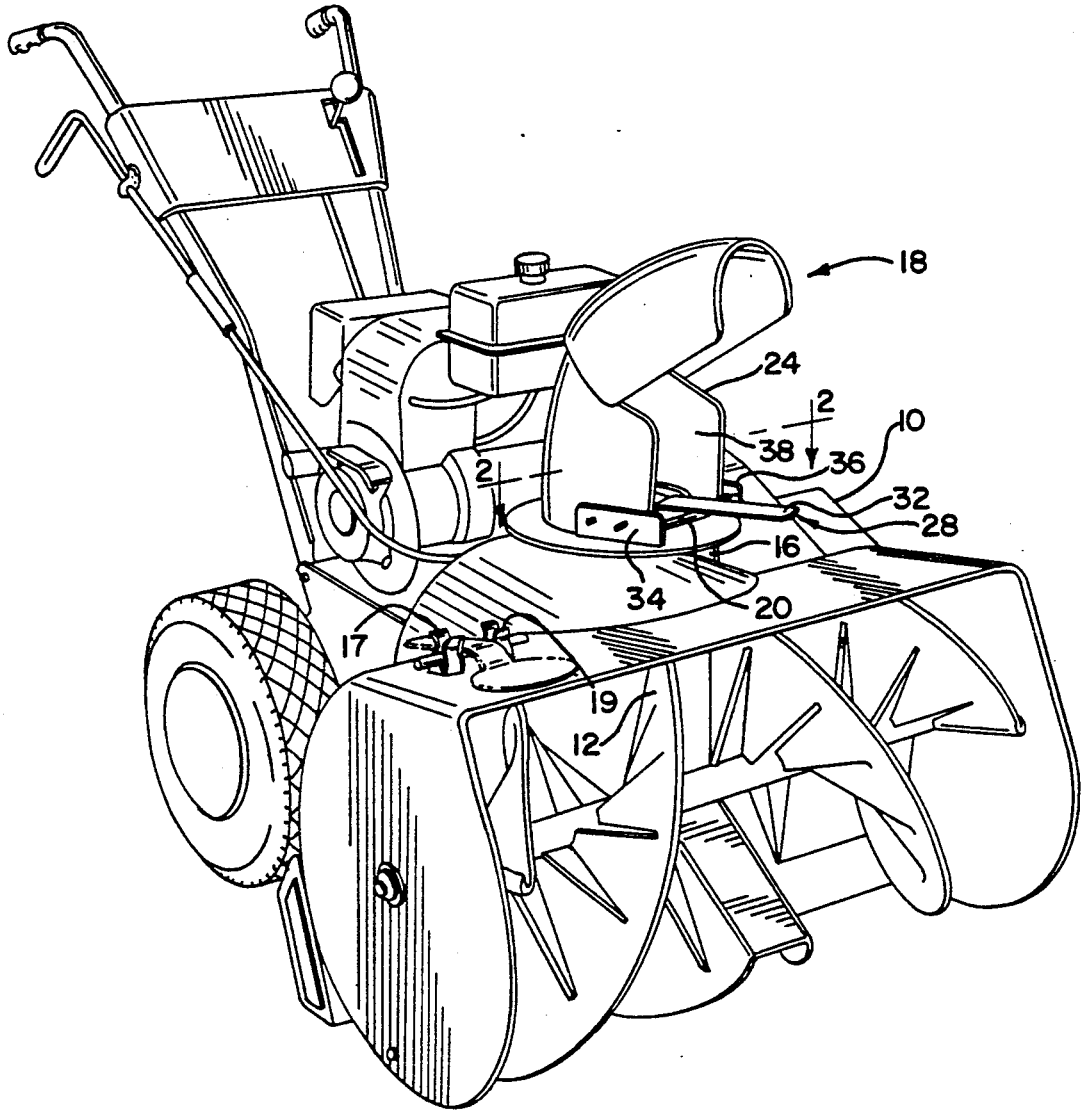
FIG. 1 is a perspective view of a rotary snow thrower of the type to which invention relates.

FIG. 1 discloses a rotary snow thrower of a well known design, at the front of which is a housing 10 that supports and partially encloses a rotary rake assembly 12. A discharge chute 118 is affixed to the top of the housing 120. The discharge chute 128 includes a stationary portion 16 which is affixed to the housing 10. The stationary portion 16 has an upper rim 20 upon which rests a movable portion 24 of the discharge chute 18. The movable portion 24 is rotatable in relation to the stationary portion 16 for the purpose of directing the discharged snow and ice in the desired direction. Storage brackets 17 and 19 are affixed to the housing 10.

Figure 3:
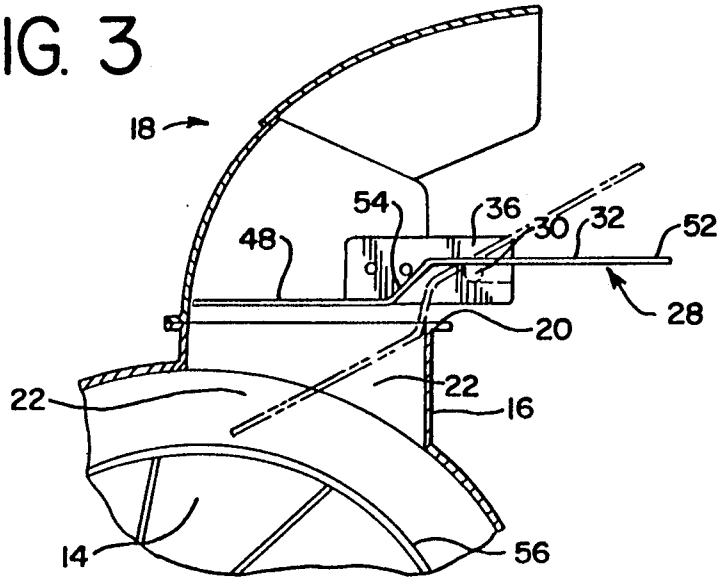
FIG. 3 is a partial sectional view of the discharge chute and impeller.

As is well known to those skilled in the art, the operator steers and controls the snow thrower through the snow to be removed, and the snow and ice are picked up by the rotary rake assembly 12. Referring to FIG. 3 in conjunction with FIG. 1, snow and ice are collected by a rotating impeller 56, mounted just below the stationary portion 16 of discharge chute 18. The impeller 56 rotates within an impeller zone 14. Adjacent of the impeller zone 14 is a passageway 22 through which the impeller 56 discharges the collected snow and ice. The stationary portion 16 of the discharge chute 18 defines a portion of passageway 22.

Figure 4:
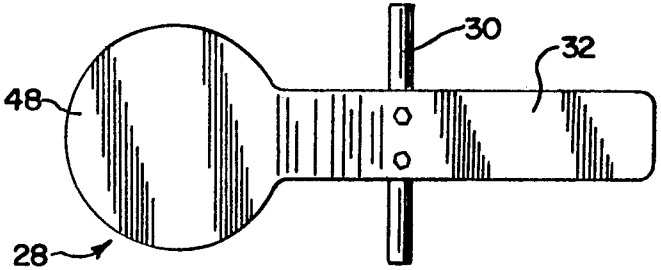
FIG. 4 is a plan view of the snow and ice removal device of the present invention.
Figure 2:
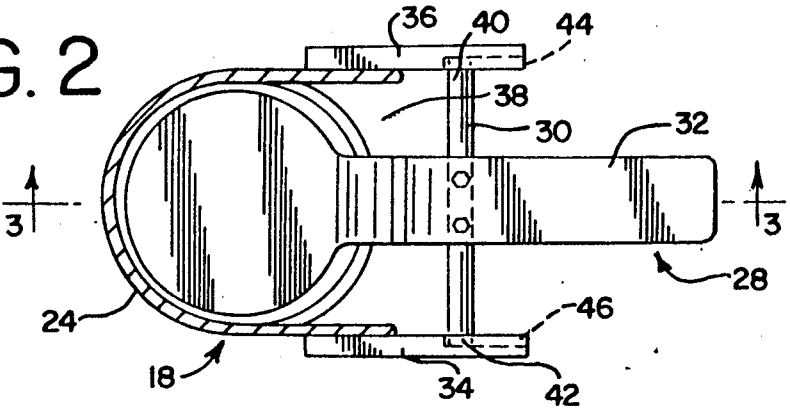
FIG. 2 is a sectional view of the discharge chute of the thrower taken on lines 2—2 of FIG. 1.

As shown in FIG. 4, a discharge chute snow and ice removal apparatus 28 includes a rigid plate 48. The rigid plate 48 is attached to a handle 32. A laterally extending rod 30 is rigidly attached to the handle 32. As shown in FIG. 2, mounting brackets 34, 36 are attached to the movable portion 24 of the discharge chute 18 and extend forwardly of the movable portion 24 so that rod 30 extends across entrance 38 and are pivotally mounted on the mounting brackets 34 and 36. In the condition shown in FIG. 1, the removable apparatus 28 has been inserted in to the mounting racket 34, 36. The handle 32 extends outward from the entrance 38.

Figure 5A:
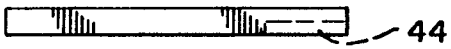
FIGS. 5*a*, 5*b* are elevation and plan views respectively of a mounting bracket.
Figure 5B:
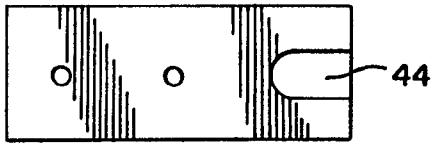
Figure 5C:
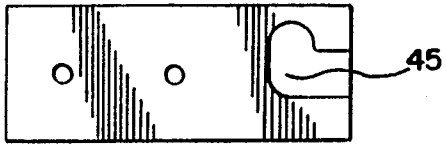
FIG. 5*c* is an elevational view of an alternate embodiment of the mounting bracket of FIG. 5*b*.

As shown in FIGS. 5*a* and 5*b*, each mounting bracket, for example 34, includes a slot element 44 that extends for a short distance along the surface facing the entrance 38 (FIG. 2). The slot element 44 does into extend through the mounting brackets 34. As shown in FIG. 2, rod extends 40*a* and 42 are removably inserted into slots 44 and 46 respectively. Upon insertion, the rod ends 40 and 42 are configured to displace snow and ice which may have accumulated in the slot 44 and 46. The shape of the rod ends 40 and 42, and the configuration of the slots 44 and 46, allow the rod to rotate. During operation of the removal apparatus 28, lateral force supplied by the operator will keep the rod ends 40 and 42 in their respective slots 44 and 46. As shown in FIG. 5*c*, an alternate embodiment of each mounting bracket, for example 34, includes a vertically directed notch 45 forming part of the slot element 44. The vertical notch 45 relieves the requirement that the operator supply lateral force to keep the rod ends 40 and 42 in their respective slots 44 and 46 during operation of the removal apparatus 28.

As shown in FIG. 3, upon removably inserting the rod 30 into the mounting brackets 34 and 36, the riding plate 48 is located above and in close proximity to the stationary portion 16 of the discharge chute 18. a first portion 52 of handle 32 extends in a plane substantially parallel and spaced form the plane or rigid plate 48. A second portion 54 of handle 32 extends between a and connects the first portion 52 to the riding plate 48. As shown in phantom in FIG. 3, rotation of the removal apparatus 28 will cause the rigid plate 48 to move within the stationary portion 16. A the maximum downward displacement of the rigid plate 48 into the stationary portion 16, corresponding to a maximum upward displacement of handle 32, the handle 32 will come into contact with the upper rim 20 of the stationary portion 16. The rigid plate will remain in the passageway 22*k* and not part of the removal apparatus 28 will intrude into the impeller zone 14 and come into contact with the impeller 56.

During operation of the snow thrower, the operator will notice the discharge chute 18 becoming plugged with snow and ice. The operator will then disengage the clutch, thereby interrupting the supply of rotational energy from the motor to the rotary rake assembly 12 and the impeller 56. The operator then disengages the removal apparatus 28 from the storage brackets 17 and 19. If there is snow and ice present in the movable portion 24 of the discharge chute 18, the operator grasps the handle 232 and uses the rigid plate 48 as a scoop to remove this snow and ice. Next the operator inserts the rod ends 40 and 42 into the slots 44 and 46 on the mounting brackets 34 and 36. The operator then rotates the handle 32 upward and correspondingly does the rigid plate 48 downward into the stationary portion 16 of the discharge chute 128 to dislodge any plug of snow and/or ice downward into the impeller zone 14 without the removable apparatus 28 coming into contact with the impeller 56. This procedure is repeated until all of the snow and ice plug is removed from stationary portion 16 of discharge chute 18.

The operator then removes the removal apparatus 28 from the discharge chute 18 and stores it on the storage brackets 17 and 19, which engage the ends of rod 30. The operator reengages the clutch, and the snow and ice which was dislodged into the impeller zone 14 is jettisoned thought snow cleared discharge chute 18.

While a particular embodiment of the now thrower discharge chute blockage removal apparatus of the present invention has been shown and described, it will be appreciated by those skilled in the art that changes and modifications may be made thereto without departing from the invention in its broader aspects as set forth in the following claims.

What is claimed is:

1. An apparatus for safely dislodging accumulated packed snow and ice formed in a plug adjacent the side walls of stationary portion of a discharge chute of a snow thrower, comprising:

rigid plate means removably and movably connected to a movable portion of the discharge chute, for insertion into and removal from the stationary portion of the discharge chute, said plate means applying an axial force to said snow and ice plug to force said snow and ice plug out of the stationary portion of the discharge chute when said plate means is moved into the stationary portion of the discharge chute; and moving means operatively connected to said rigid plate means to selectively move said plate means into and out of the stationary portion of the discharge chute to apply said axial force.

2. The apparatus of claim 2, including a pivotal connection between the moving means and the movable portion of the discharge chute.

3. The apparatus of claim 2, wherein said pivotal connection includes a slotted member connected to the movable portion of the discharge chute; and rod means attached to and extending from said actuating means, each end of said rod means being configured to e removably inserted into said slotted member for pivotal movement of said moving means.

4. The apparatus of claim 3, wherein each end of said rod means is configured to displace snow and ice Accumulated in said slotted member as said rod means are inserted into said slotted member.

5. The apparatus of claim 1 wherein said moving means includes a handle attached to said rigid plate means; and pivotal connection means between said handle and the movable portion of the discharge chute for pivotal movement of said rigid plate means into and out of the stationary portion of the discharge chute.

6. The apparatus of claim 5 wherein said handle includes a first portion extending in a first plane substantially parallel and spaced from the plane of said rigid plate means; and a second portion extending between and connecting said first portion of said handle to said rigid plate means such that said first portion of said handle extends outwards from the movable portion of said discharge chute.

7. The apparatus of claim 6 wherein said pivotal connection means extends from said first portion of said handle and cooperates with slotted connection means on the movable portion of the discharge chute, said handle and rigid plate means being insertable in and removable from said slotted connection means.

8. The apparatus of claim 5 wherein the snow thrower includes an impeller zone which includes a rotary impeller for engaging snow to be removed and discharging the snow through the discharge chute, and a passageway adjacent the impeller zone, the stationary portion of the discharge chute defining a portion of the passageway;

said pivotal connection means, said handle and said rigid plate means being configured such that said rigid plate means extends only into the passageway when said rigid plate means is pivotally moved by said handle into the stationary portion of the discharge chute.

9. The apparatus of claim 8 wherein the stationary portion includes an upper edge; and upon displacement of said rigid plate means immediately adjacent to the impeller zone, said handle rests on the upper edge.

10. An apparatus for safely dislodging accumulated packed snow and ice formed in a plug adjacent the side walls of a stationary portion of a discharge chute of a snow thrower, comprising:

rigid plate means removably and movably connected to an element of the snot thrower for insertion in and removal from the discharge chute, said plate means applying an axial force to the snow and ice plug to force the snow and ice plug out of the discharge chute when said plate means is moved into said discharge chute; and moving means operatively connected to said rigid plate means to selectively move said late means in said discharge chute.

* * * * *

UNITED STATES PATENT AND TRADEMARK OFFICE

CERTIFICATE OF CORRECTION

PATENT NO. : 5,163,239

DATED : November 17, 1992

INVENTOR(S) : D. Lampe

It is certified that error appears in the above-identified patent and that said Letters Patent is hereby corrected as shown below:

Col. 1, line 20, delete the second "of".
Col. 1, line 21, delete "e" and insert -- be --.
Col. 1, line 22, after "Operators" delete the comma.
Col. 1, line 47, delete "form" and insert -- from --.
Col. 1, line 47, delete "for" and insert -- For --.
Col. 1, line 57, delete "potion" and insert -- portion --.
Col. 1, line 59, delete "si" and insert -- is --.
Col. 1, line 62, delete "of the" and insert -- other --.
Col. 2, line 2, delete "lug" and insert -- plug --.
Col. 2, line 38, delete "IN" and insert -- In --.
Col. 2, line 55, delete "of" and insert -- to --.
Col. 2, line 56, delete "e" and insert -- be --.
Col. 2, line 58, delete "cute" and insert -- chute --.
Col. 2, line 61, delete "form" and insert -- from --.
Col. 2, line 67, delete "reovavable" and insert -- removal --.
Col. 3, line 2, delete "throswer's" and insert -- thrower's --.
Col. 3, line 6, after "which" insert -- the --.
Col. 3, line 15, delete "elevational" and insert -- elevation --.
Col. 3, line 23, delete "118" and insert -- 18 --.
Col. 3, line 24, delete "120" and insert -- 10 --.
Col. 3, line 24, delete "128" and insert -- 18 --.
Col. 3, line 54, delete "in to" and insert -- into --.
Col. 3, line 54, delete "racket" and insert -- brackets --.
Col. 3, line 59, delete "into" and insert -- not --.
Col. 3, line 61, delete "extends" and insert -- ends --.
Col. 3, line 61, delete "40a" and insert -- 40 --.
Col. 3, line 64, delete "slot" and insert -- slots --.

UNITED STATES PATENT AND TRADEMARK OFFICE

CERTIFICATE OF CORRECTION

PATENT NO. : 5,163,239

DATED : November 17, 1992

INVENTOR(S) : D. Lampe

It is certified that error appears in the above-identified patent and that said Letters Patent is hereby corrected as shown below:

Col. 4, line 10, delete "riding" and insert -- rigid --.
Col. 4, line 12, delete "a" and insert -- A --.
Col. 4, line 14, delete "or" and insert -- of --.
Col. 4, line 15, delete "a".
Col. 4, line 16, begin a new paragraph at "As".
Col. 4, line 24, delete "22k" and insert -- 22 --.
Col. 4, line 24, after "22" insert a comma.
Col. 4, line 25, delete "not" and insert -- no --.
Col. 4, line 37, delete "232" and insert -- 32 --.
Col. 4, line 41, delete "does" and insert -- moves --.
Col. 4, line 43, delete "128" and insert -- 18 --.
Col. 4, line 43, delete "and-" and insert -- and --.

Col. 4, line 55, delete "now" and insert -- snow --.
Col. 4, line 60, after "aspects" insert -- and --.

In the claims:

Column 5, line 12, delete "2" and insert --1--
Col. 5, line 20, delete "e" and insert -- be --.
Col. 5, line 24, delete "Accu-" and insert -- accu---.

UNITED STATES PATENT AND TRADEMARK OFFICE

CERTIFICATE OF CORRECTION

PATENT NO. : 5,163,239

DATED : November 17, 1992

INVENTOR(S) : D. Lampe

It is certified that error appears in the above-indentified patent and that said Letters Patent is hereby corrected as shown below:

Col. 6, line 32, delete "snot" and insert --snow--

Signed and Sealed this

Twelfth Day of April, 1994

Bruce Lehman

*Attest:*

BRUCE LEHMAN

*Commissioner of Patents and Trademarks*

*Attesting Officer*